US009103004B2

(12) United States Patent
MacLeod

(10) Patent No.: US 9,103,004 B2
(45) Date of Patent: Aug. 11, 2015

(54) HARDFACING COMPOSITION AND ARTICLE HAVING HARDFACING DEPOSIT

(75) Inventor: Moira E. MacLeod, Bella Vista, AR (US)

(73) Assignee: KENNAMETAL INC., Latrobe, PA (US)

( * ) Notice: Subject to any disclaimer, the term of this patent is extended or adjusted under 35 U.S.C. 154(b) by 867 days.

(21) Appl. No.: 13/220,834

(22) Filed: Aug. 30, 2011

(65) Prior Publication Data

US 2011/0311820 A1 Dec. 22, 2011

Related U.S. Application Data

(63) Continuation-in-part of application No. 12/065,777, filed as application No. PCT/US2006/038702 on Oct. 2, 2006, now abandoned.

(60) Provisional application No. 60/723,122, filed on Oct. 3, 2005.

(51) Int. Cl.

| | |
|---|---|
| ***C22C 26/00*** | (2006.01) |
| ***C22C 29/06*** | (2006.01) |
| ***C22C 29/08*** | (2006.01) |

(52) U.S. Cl.

CPC ..... *C22C 26/00* (2013.01); *C22C 29/067* (2013.01); *C22C 29/08* (2013.01); *Y10T 428/2982* (2015.01)

(58) Field of Classification Search

USPC ..... 75/252

See application file for complete search history.

(56) References Cited

U.S. PATENT DOCUMENTS

| | | | |
|---|---|---|---|
| 2,280,223 | A | 4/1942 | Dumplemann et al. |
| 2,841,687 | A | 7/1958 | Richter |
| 3,379,503 | A | 4/1968 | McKenna |
| 3,989,554 | A | 11/1976 | Wisler |
| 4,834,963 | A | 5/1989 | Terry et al. |
| 4,944,774 | A | 7/1990 | Keshavan et al. |
| 5,051,112 | A | 9/1991 | Keshavan et al. |
| 5,152,194 | A | 10/1992 | Keshavan et al. |
| 5,250,355 | A | 10/1993 | Newman et al. |
| 5,518,077 | A | 5/1996 | Blackman et al. |
| 5,715,899 | A | 2/1998 | Liang et al. |
| 5,733,649 | A | 3/1998 | Kelley et al. |
| 5,791,422 | A | 8/1998 | Liang et al. |
| 5,944,127 | A | 8/1999 | Liang et al. |
| 6,659,206 | B2 | 12/2003 | Liang et al. |
| 2003/0079565 | A1 | 5/2003 | Liang et al. |
| 2003/0183425 | A1 | 10/2003 | Liang et al. |
| 2004/0112358 | A1 | 6/2004 | Dossena et al. |
| 2004/0140133 | A1 | 7/2004 | Liang |
| 2004/0202885 | A1 | 10/2004 | Seth et al. |

FOREIGN PATENT DOCUMENTS

| | | |
|---|---|---|
| EP | 0753375 | 1/2001 |
| EP | 0909869 | 6/2003 |
| GB | 2395202 A | 5/2004 |
| WO | 9623907 A | 8/1996 |

OTHER PUBLICATIONS

German, Randall M., "Powder Metallurgy Science", Metal Powder Industries Federation, (1984) pp. 27-28.

PCT Notification of Transmittal of the International Search report or the Declaration for PCT/US06/38702 (1 page) mailed on Sep. 25, 2007.

International Search report for PCT/US06/38702 (2 pages) mailed Sep. 25, 2007.

Written Opinion of International Searching Authority for PCT/US06/38702 (4 pages) mailed Sep. 25, 2007.

Communication (Search Report) of Nov. 28, 2011 from the European Patent Office in European Patent Application 06816157.9 [13 pages].

*Primary Examiner* — George Wyszomierski
*Assistant Examiner* — Ngoclan T Mai
(74) *Attorney, Agent, or Firm* — Larry R. Meenan

(57) ABSTRACT

A hardfacing composition (32) that includes a plurality of hard particles (54) wherein the hard particles (54) include a mode particle size distribution, one particle size distribution smaller than the mode particle size distribution, and an other particle size distribution larger than the mode particle size distribution. There is an absence of any substantial fluctuations in the particle size distribution between the mode particle size distribution and the one particle size distribution. There is an absence of any substantial fluctuations in the particle size distribution between the mode particle size distribution and the other particle size distribution.

17 Claims, 6 Drawing Sheets

HARDFACING COMPOSITION AND ARTICLE HAVING HARDFACING DEPOSIT

CROSS-REFERENCE TO EARLIER PATENT APPLICATIONS

This patent application is a continuation-in-part patent application by Moira E. MacLeod to co-pending U.S. patent application Ser. No. 12/065,777 [filed on Mar. 5, 2008 by Moira E. MacLeod], which is the national stage patent application based on PCT Patent Application PCT/US2006/038702 with an international filing date of Oct. 2, 2006, which claims the priority benefit of U.S. Provisional Patent Application Ser. No. 60/723,122 filed Oct. 3, 2005 [naming Moira E. MacLeod as the inventor]. Applicant hereby claims for this patent application the priority of U.S. patent application Ser. No. 12/065,777 [filed on Mar. 5, 2008 by Moira E. MacLeod] and PCT Patent Application No PCT/US2006/038702 [naming Moira E. MacLeod as the inventor] and U.S. Provisional Patent Application Ser. No. 60/723,122 filed Oct. 3, 2005 [naming Moira E. MacLeod as the inventor].

BACKGROUND OF THE INVENTION

The present invention relates to a hardfacing composition, as well as an article having a hardfacing deposit. More particularly, the invention pertains to a hardfacing composition that is typically applied via a hardfacing rod, as well as an article having a hardfacing deposit, wherein the hardfacing deposit exhibits a microstructure that has improved consistency, as well as improved properties including wear properties such as, for example, abrasion resistance and erosion resistance.

Earth-engaging tools such as, for example, a rotary cone rock bit, typically operate in environments that subject the tools to wear such as erosive wear and abrasive wear. In order for such tools to function in a satisfactory manner, it is important for them to be able to resist wear including erosion and abrasion.

Heretofore, it has been known to deposit a hardfacing on the surface of an article (or substrate) whereby the hardfacing imparts improved properties, and especially wear properties including erosion resistance and abrasion resistance, to the article. Exemplary articles include an earth boring bit (e.g., a steel tooth rolling cutter drill bit) such as shown and described in European Patent No. 0 909 869 B1 to Camco International Inc. and in European Patent No. 0 53 375 B1 to Camco International Inc. U.S. Pat. No. 5,944,127 to Liang et al. and U.S. Pat. No. 6,659,206 to Liang et al. each disclose a rock bit that has a hardfacing deposit. Thus, it can be appreciated that hardfacing is used to extend the service life of drill bits (e.g., a rotary cone rock bit) and other downhole tools used in the oil and gas industry.

Hardfacing can be generally defined as applying a layer of hard, abrasion resistant material to the surface of a less abrasion resistant substrate such as, for example, steel, by plating, welding, spraying or other well-known deposition techniques. Tungsten carbide and its various alloys are sometimes used as hardfacing materials. Hardfacing is typically a mixture of a hard, wear-resistant material embedded in a matrix deposit which is preferably fused with the surface of a substrate by forming metallurgical-type bonds to ensure uniform adherence of the hardfacing to the substrate.

A wide variety of hardfacing materials have been satisfactorily used on drill bits and other downhole tools. Frequently used hardfacing material includes sintered tungsten carbide particles in an alloy steel matrix deposit. Other forms of tungsten carbide particles may include grains of monotungsten carbide (WC), ditungsten carbide ($W_2C$) and/or macrocrystalline tungsten carbide and/or crushed cast tungsten carbide. Further, other metal carbides and/or nitrides, in addition to tungsten carbide, can be used to form a hardfacing deposit. Satisfactory binder materials for the hardfacing may include materials such as cobalt, iron, nickel, alloys of iron, as well as other metallic alloys.

Macrocrystalline tungsten carbide is essentially stoichiometric WC, which is, for the most part, in the form of single crystals. Some large crystals of macrocrystalline tungsten carbide are bicrystals. U.S. Pat. No. 3,379,503 to McKenna, assigned to the assignee of the present patent application, discloses a method of making macrocrystalline tungsten carbide. U.S. Pat. No. 4,834,963 to Terry et al., assigned to the assignee of the present patent application, also discloses a method of making macrocrystalline tungsten carbide.

Crushed sintered cemented (cobalt) macrocrystalline tungsten carbide comprises small particles of tungsten carbide bonded together in a metal matrix. One makes crushed sintered cemented (cobalt) macrocrystalline tungsten carbide through the crushing of previously sintered carbide into blocky and non-blocky shapes wherein this crushed sintered macrocrystalline cemented (cobalt) tungsten carbide. One source of the crushed sintered cemented (cobalt) macrocrystalline tungsten carbide is Kennametal Inc. of Latrobe Pa. 15650 wherein this material is sold under the designation Kenface.

To produce cemented carbide-cobalt pellets, tungsten carbide particles, cobalt powder and a lubricant are mixed together into a mixture. This mixture is pelletized and through a rolling process the mixture of tungsten carbide, cobalt and lubricant ball up into pellets.

Crushed cast tungsten carbide forms two carbides; namely, monotungsten carbide (WC) and ditungsten carbide ($W_2C$). There can be a continuous range of compositions between the monotungsten carbide and the ditungsten carbide. The eutectic mixture is about 4.5 weight percent carbon. Commercially available cast tungsten carbide typically used as a matrix powder generally has a hypoeutectic carbon content of about 4 weight percent. Cast tungsten carbide is typically frozen from the molten state and comminuted to the desired particle size to from the crushed cast tungsten carbide.

One way to apply the hardfacing deposit is to use a hardfacing rod. In this regard, U.S. Pat. No. 5,250,355 to Newman et al. discloses the use of a hardfacing rod to apply the hardfacing deposit. While there may be some variations, generally speaking, a hardfacing rod comprises a hollow tube or rod that contains hard particles. The hard particles are applied to the surface of the article or substrate via welding techniques to form the hardfacing deposit. The hardfacing deposit includes a matrix (e.g., steel or the like) that comes from the substrate itself or from the welding rod or hollow rod. This technique of applying the hardfacing deposit is sometimes referred to as "tube rod welding."

While these earlier hardfacing compositions, including the hardfacing deposits formed from these compositions using hardfacing rods, have performed in a satisfactory fashion, there remains room for improvement. Thus, it would be desirable to provide an improved hardfacing deposit on an article that overcomes drawbacks associated with the current hardfacing compositions containing hard particles and current hardfacing deposits on an article.

For example, in the current hardfacing compositions containing hard particles, the nature of the particle size distribution of the hard particles results in some drawbacks. More specifically, the particle size distribution in the current hardfacing compositions leaves so-called gaps in the particle size distribution. What this means is that the hardfacing composition does not include hard particles having sizes within certain ranges of particle size distributions. The absence of these particles creates an interruption to the smooth distribution of hard particles across the spectrum of available particle size distributions. Because these gaps (or absences) can lead to certain problems for the hardfacing rod prior to use, as well as for the hardfacing deposit applied to an article, it would desirable to provide an improved hardfacing composition containing hard particles that reduces or eliminates the gaps in the particle size distribution.

One of the drawbacks extant with the presence of gaps in the particle size distribution of the hardfacing composition, and especially with respect to a hardfacing rod, is the possibility of the hard particles to shift their position within the hardfacing rod when jostled or struck or otherwise impacted during handling prior to baking, and such shift in position may occur even after baking as well. This shifting of the hard particles is due to an absence of mechanical support for all of the hard particles, and especially for those particles that are of a size somewhat smaller than the absent particle size distribution that creates the gap in the particle size distribution. Shifting of the hard particles in the hardfacing rod can result in a hardfacing deposit that has an inconsistent microstructure, which can result in less than optimum wear resistance properties. This inconsistency is also thought to create problems during the application of the rod hardfacing itself by having pockets of material deposited instead of the deposition of a homogeneous mixture. Thus, it would be desirable to provide an improved hardfacing composition (including an improved hardfacing rod) containing hard particles that does not present gaps in the particle size distribution so as to reduce or eliminate the shifting of particles due to the jostling of the hardfacing rod as well as to maximize the distribution to increase wear properties.

Another drawback extant with the presence in gaps in the particle size distribution of the hardfacing composition, and especially with a hardfacing rod, is the tendency of the hard particles to migrate to the bottom of the liquid weld pool during the weld pool solidification. As mentioned above, gaps in the particle size distribution of the hard particles leads to a lack of mechanical support for the hard particles. When the weld pool is liquid, this lack of mechanical support allows the hard particles to migrate to the bottom of the weld pool.

The migration of the hard particles results in a non-uniform hardfacing deposit upon the solidification of the weld pool in which the hard particles are generally uniformly distributed throughout the microstructure of the hardfacing deposit. A non-uniform hardfacing deposit leads to uneven wear of the hardfacing deposit during use. Thus, it would be desirable to provide an improved hardfacing composition (including an improved hardfacing rod) containing hard particles that does not present gaps in the particle size distribution, and as a result, there is a reduction or elimination of the migration of the hard particles in the liquid weld pool during the welding operation.

Still another one of the drawbacks extant with the presence in gaps in the particle size distribution of the hardfacing composition, and especially with a hardfacing rod, is the tendency of the deoxidizer (which is a typical component of the hardfacing composition) to segregate in the hardfacing rod. Such segregation could potentially occur when the hardfacing rod is being produced or prior to baking of the hardfacing rod. When the deoxidizer is segregated in the hardfacing composition, there is the tendency to impede the effective release of gases during the welding operation when the weld pool is liquid. By impeding the effective release of the gases, trapped gas pockets form in the weld pool. The presence of these gas pockets could potentially cause the hardfacing deposit to exhibit porosity. Thus, it would be desirable to provide an improved hardfacing composition (including an improved hardfacing rod) that does not present gaps in the particle size distribution, and thereby reduces or eliminates the segregation of deoxidizer so as to reduce or eliminate the presence of trapped gas pockets in the hardfacing deposit.

SUMMARY OF THE INVENTION

In one form thereof, the invention is a hardfacing composition that comprises a plurality of hard particles wherein the hard particles comprise a mode particle size distribution, one particle size distribution smaller than the mode particle size distribution and an other particle size distribution larger than the mode particle size distribution. There is a substantially smooth transition between the mode particle size distribution and the one particle size distribution. There is a substantially smooth transition between the mode particle size distribution and the other particle size distribution.

In still another form, the invention is a hardfacing composition that comprises a plurality of hard particles wherein the hard particles comprise a mode particle size distribution, one particle size distribution smaller than the mode particle size distribution and an other particle size distribution larger than the mode particle distribution. There is an absence of any substantial fluctuations in the particle size distribution between the mode particle size distribution and the one particle size distribution. There is an absence of any substantial fluctuations in the particle size distribution between the mode particle size distribution and the other particle size distribution.

In still another form, the invention is a hardfacing composition having selected weldability characteristics and selected wear resistance properties wherein the hardfacing composition comprises a plurality of hard particles. The hard particles comprise a plurality of hard particle size distributions wherein the hard particle size distributions comprise the following hard particle size distributions: a coarse hard particle size distribution wherein the hard particles in the coarse hard particle size distribution enhance wear resistance of the hardfacing composition, a fine hard particle size distribution wherein the hard particles in the fine hard particle size distribution enhance weldability characteristics, and a mediate hard particle size distribution wherein the hard particles in the mediate hard particle size distribution facilitate generally uniform distribution of the hard particles in the fine hard particle size distribution of the hardfacing composition. The coarse hard particle size distribution, the fine hard particle size distribution, and the medium hard particle size distribution are present in amounts to provide the selected weldability characteristics and selected wear resistance properties of the hardfacing composition.

BRIEF DESCRIPTION OF THE DRAWINGS

The following is a brief description of the drawings which form a part of this patent application.

DETAILED DESCRIPTION OF SPECIFIC EMBODIMENTS

Figure 1:
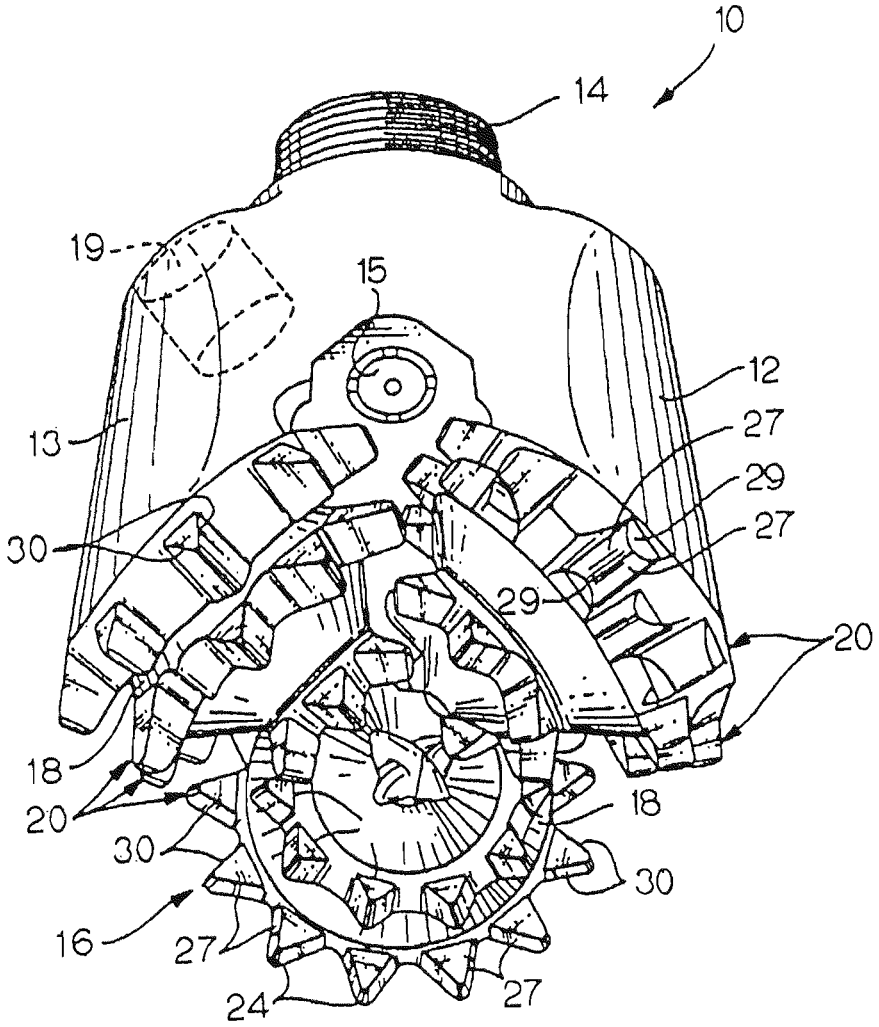
FIG. 1 is an isometric view of a milled tooth rotary cone rock bit with hardfacing material on each tooth.
Figure 2:
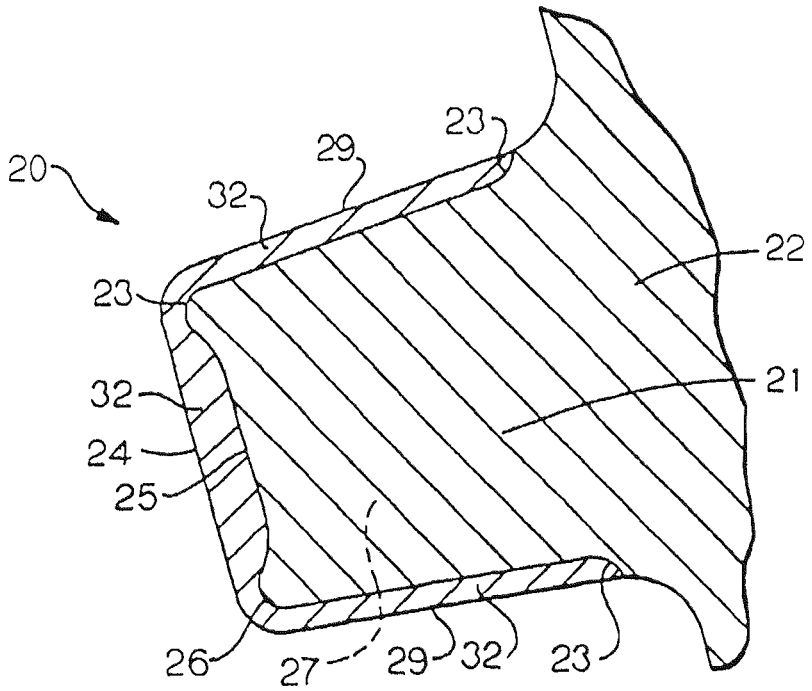
FIG. 2 is a cross-sectional view of a milled tooth from FIG. 1 showing the hardfacing on the surface of the tooth.

Referring to the drawings, FIG. 1 illustrates a mill tooth rotary cone rock bit generally designated as 10. This rotary cone rock bit is shown and described in U.S. Pat. No. 5,152,194 to Keshavan et al. wherein this patent is hereby incorporated by reference herein. The following is a brief description of the rotary cone rock bit.

The rock bit 10 includes a bit body 12 that is threaded at pin end 14 and cutting end generally designated as 16. Each leg 13 supports a rotary cone 18 rotatively retained on a journal cantilevered from each of the legs (not shown). The mill teeth generally designated as 20 extending from each of the cones 18 is typically milled from steel.

Each of the chisel crested teeth 20 forms a crest 24, a base 22, two flanks 27, and tooth ends 29.

As indicated before hardfacing material is generally applied on each of the teeth 20. In some cases the application of hardfacing is applied only to the cutting side of the tooth as opposed to the other flanks and ends of the teeth.

The rock bit 10 further includes a fluid passage through pin 14 that communicates with a plenum chamber 17 (not shown). Typically one or more nozzles 15 are secured within body 12. The nozzles direct from plenum chamber 17 towards a borehole bottom. The upper portion of each of the legs may have a lubricant reservoir 19 to supply a lubricant to each of the rotary cones 18.

The chisel tooth generally designated as 20 consists of, for example, steel foundation 21, forming flanks 27, ends 29 and a crest 24. Between the rounded corners 26 is a concave portion 25 formed by the crest 24 of the tooth. The concave portion 25 enables the hardfacing material to form a thicker portion at the middle of the crest 24 therefore providing a more robust cutting crest 24. Each of the corners 26 have a sufficient radius so that the thickness of the hardfacing material is assured as it transitions from the crest 24 towards the ends 29 and the flanks 27 of the tooth 20. The hardfacing material terminates in a groove or shoulder 23 formed at the base 22 at each of the teeth 20. The shoulder or groove 23 provides a termination point for the hardfacing material 32 as it is applied over the crest ends and flanks of each of the teeth 20.

By providing a concave portion or depression 25 and rounded corners 26 at the end of the crested tooth, the hardfacing material may be applied more generously in the center of the crest and at a sufficient thickness around the rounded corners 26. The large radius at the corners assure a thick hardfacing material at a vulnerable area of the tooth.

Figure 3:
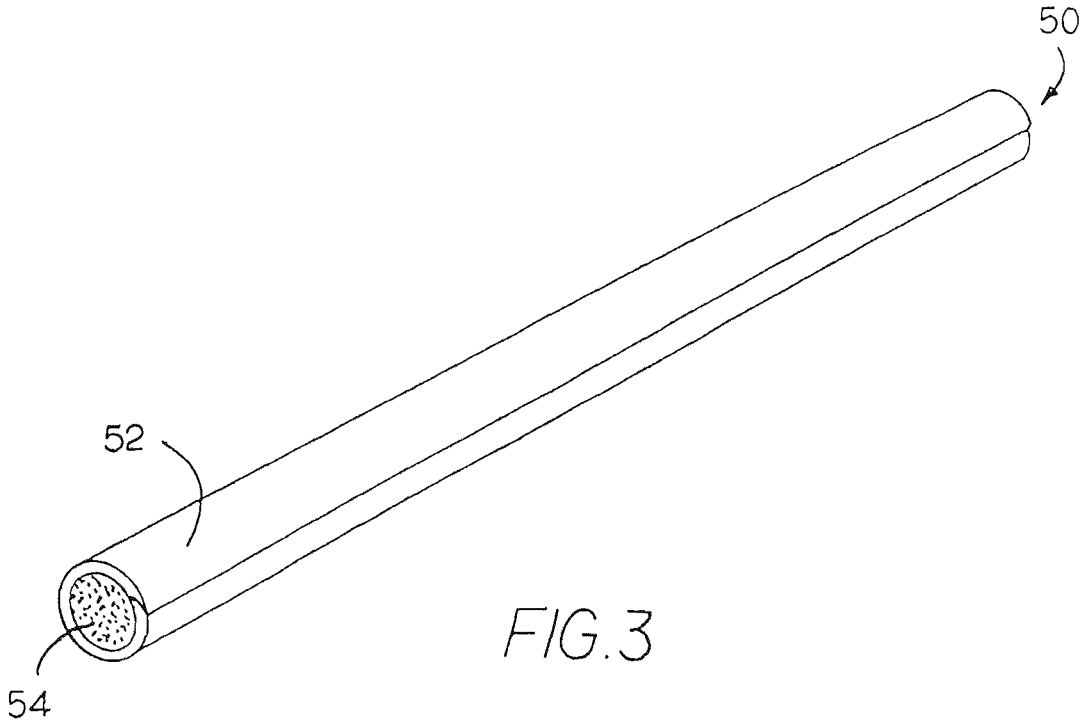
FIG. 3 is an isometric view of a hardfacing rod.

FIG. 3 shows a hardfacing rod 50 that comprises a tube 52 which contains hard particles 54.

A comparative hardfacing composition, which is designated as Comparative Example A, is set forth in Table 1 below.

TABLE 1

Hardfacing Composition of Comparative Example A (Original Formulation)

| Description | Wt. % |
|---|---|
| 16/20 pellets | 70 |
| 40/80 cast | 14 |
| 40/80 Kenface | 12 |
| 60/170 Si—Mn | 4 |

In Table 1, the left column presents the type of hard material and the particle size range in Mesh wherein, for example, 16/20 means—16+20 Mesh. In regard to the type of hard material, the term "pellets" refers to cemented tungsten carbide-cobalt pellets. The term "cast" refers to cast tungsten carbide particles and the term "Kenface" refers to the Kenface crushed sintered cemented (cobalt) macrocrystalline tungsten carbide particles available from Kennametal Inc. The term Si—Mn refers to a silicon-manganese deoxidizer. The above description of the materials listed in Table 1 is applicable to the other tables in the application where appropriate. The right column of Table 1 presents the content of the hard material in weight percent.

Set forth below in Table 2 is Inventive Example No. 1, which is one composition of the hardfacing. A comparison of the composition of Comparative Example A and Inventive Example No. 1 shows that the particle size distribution has expanded toward the smaller particle sizes in that there is a component of −325 Mesh tungsten carbide particles (WC), and the cast tungsten carbide particles now have a −100+200 Mesh size range in addition to the −40+80 Mesh particle size range.

There has also been a reduction in the gap with respect to the coarser (−16+20 Mesh) cemented tungsten carbide-cobalt pellets. In this regard, the amount of −16+20 Mesh pellets was reduced from 70 weight percent to 15 weight percent and 55 weight percent of smaller (−20+30 Mesh) cemented tungsten carbide-cobalt pellets was added as a component. The size of the Kenface component was increased from −40/+80 Mesh to −20/+30 Mesh.

Overall, it can be seen that these changes in composition between the Comparative Example A and Inventive Example No. 1 result in a particle size distribution in which there is a substantially smooth transition between the mode particle size distribution and the smaller particle size distribution (i.e., one particle size distribution smaller than the mode particle size distribution), as well as a substantially smooth transition between the mode particle size distribution and the larger particle size distribution (i.e., an other particle size distribution larger than the mode particle size distribution). Further, it should be appreciated that there is an absence of any substantial fluctuations in the particle size distribution between the mode particle size distribution and the smaller particle size distribution (i.e., one particle size distribution smaller than the mode particle size distribution), as well as there is an absence of any substantial fluctuations in the particle size distribution between the mode particle size distribution and the larger particle size distribution (i.e., an other particle size distribution larger than the mode particle size distribution).

TABLE 2

| Hardfacing Composition (Weight Percent) of Inventive Example No. 1 | |
|---|---|
| Description | Wt. % |
| 16/20 pellets | 15 |
| 20/30 pellets | 55 |
| 20/30 Kenface | 8 |
| 40/80 cast | 8 |
| 100/200 cast | 5 |
| 60/170 Si—Mn | 4 |
| −325 mesh WC | 5 |

In Table 2, the left column presents the particle size range and the hard material and the right column presents the composition in weight percent. In Table 2 as well as in the other tables, where applicable, the term "WC" refers to tungsten carbide particles.

Table 3 below presents the hardfacing composition for Inventive Example No. 2. In Inventive Example No. 2, a comparison of Comparative Example A and Inventive Example No. 2 shows that the content of the −16+20 Mesh cemented tungsten carbide-cobalt pellets was reduced from 70 weight percent to 15 weight percent and that the particle size distribution of the cemented tungsten carbide-cobalt pellets included 23 weight percent −20+30 Mesh pellets and 32 weight percent −30+40 Mesh pellets. This change provided a more substantially smooth transition from the mode particle size to the larger particle sizes. By this it can be appreciated that there is an absence of any substantial fluctuations in the particle size distribution between the mode particle size distribution and the larger particle size distribution. This in combination with the various shapes of the particles that are chosen as set forth above will positively affect how the structure will pack during the weld pool solidification process.

The balance of the components in Inventive Example No. 2 are along the lines of Inventive Example No. 1 so that there is a substantially smooth transition between the mode particle size distribution and the smaller particle size distribution. In the overall composition, it can be appreciated that there is an absence of any substantial fluctuations in the particle size distribution between the mode particle size distribution and the smaller particle size distribution, as well as there is an absence of any substantial fluctuations in the particle size distribution between the mode particle size distribution and the larger particle size distribution.

TABLE 3

| Hardfacing Composition (Weight Percent) of Inventive Example No. 2 | |
|---|---|
| Description | Wt. % |
| 16/20 pellets | 15 |
| 20/30 pellets | 23 |
| 30/40 pellets | 32 |
| 40/80 Kenface | 6 |
| 40/80 cast | 10 |
| 100/200 cast | 5 |
| 60/170 Si—Mn | 4 |
| −325 mesh WC | 5 |

Inventive Example No. 3 below (Table 4) presents a hardfacing composition in which the cemented tungsten carbide-cobalt pellet component was spread out from 70 weight percent −16+20 Mesh to 20 weight percent −20+30 Mesh pellets and 50 weight percent −30+40 Mesh pellets. This change provided a more substantially smooth transition from the mode particle size to the larger particle sizes. By this it can be appreciated that there is an absence of any substantial fluctuations in the particle size distribution between the mode particle size distribution and the larger particle size distribution.

The balance of the components are along the lines of Inventive Example No. 1 so that there is a substantially smooth transition between the mode particle size distribution and the smaller particle size distribution. In the overall composition, it can be appreciated that there is an absence of any substantial fluctuations in the particle size distribution between the mode particle size distribution and the smaller particle size distribution, as well as there is an absence of any substantial fluctuations in the particle size distribution between the mode particle size distribution and the larger particle size distribution.

TABLE 4

| Hardfacing Composition (Weight Percent) of Inventive Example No. 3 | |
|---|---|
| Description | Wt. % |
| 20/30 pellets | 20 |
| 30/40 pellets | 50 |
| 40/80 Kenface | 6 |
| 40/80 cast | 10 |
| 100/200 cast | 5 |
| 60/170 Si—Mn | 4 |
| −325 mesh | 5 |

Table 5 below sets forth the composition of Comparative Example B.

TABLE 5

| Hardfacing Composition (Weight Percent) of Comparative Example No. B (Original Formulation) | |
|---|---|
| Description | Wt. % |
| 30/40 pellets | 71.5 |
| 40/80 cast | 15.5 |
| 40/80 Kenface | 13.5 |
| 60/170 Si—Mn | 4 |

In Inventive Example No. 4 (Table 6 below), the original hardfacing of Comparative Example B has been spread out to include more materials. Table 6 sets forth the composition of Inventive Example No. 4.

More specifically, the particle size distribution of the cemented tungsten carbide-cobalt pellets was changed from 71.5 weight percent −30+40 Mesh pellets to a wider distribution toward the larger particles. In this regard, the pellets comprise 4 weight percent −10+24 Mesh pellets, 8 weight percent −18+35 Mesh pellets, 18 weight percent −20+30 Mesh pellets and 30 weight percent −30+40 Mesh pellets. There is also a −100+325 Mesh pellet component.

The particle size distribution of the cast tungsten carbide component was spread out moving from 15.5 weight percent −40+80 Mesh to −40+80 Mesh (5 weight percent) and −100+200 Mesh (5 weight percent). The 13.5 weight percent −40+80 Mesh Kenface component was also spread out to −20+40

Mesh (10 weight percent) and −40+80 Mesh (7 weight percent). There was also an addition of −325 Mesh tungsten carbide particles.

Overall, it can be seen that these changes in composition between the Comparative Example B and Inventive Example No. 4 result in a particle size distribution in which there is a substantially smooth transition between the mode particle size distribution and the smaller particle size distribution, as well as a substantially smooth transition between the mode particle size distribution and the larger particle size distribution. Further, there is an absence of any substantial fluctuations in the particle size distribution between the mode particle size distribution and the smaller particle size distribution, as well as there is an absence of any substantial fluctuations in the particle size distribution between the mode particle size distribution and the larger particle size distribution.

TABLE 6

Hardfacing Composition (Weight Percent) of Inventive Example No. 4

| Description | Wt. % |
|---|---|
| 10 × 24 pellets | 4 |
| 18 × 35 pellets | 8 |
| 20/30 pellets | 18 |
| 30/40 pellets | 30 |
| 100 × 325 pellets | 5 |
| 20/40 Kenface | 10 |
| 40/80 Kenface | 7 |
| 40/80 cast | 5 |
| 100/200 cast | 5 |
| 60/170 Si—Mn | 4 |
| −325 mesh WC | 4 |

Applicant presents in Table 7 below wear data performed according to a B611 test.

TABLE 7

Hardfacing coupons-new raw materials (B611)
Modified rod for improved weldability
High stress (B611)

| Designation | $Mass_1$ | $Mass_2$ | Wt. loss | P (g/cc) | B611 | Normalized #* |
|---|---|---|---|---|---|---|
| Comp. Ex. A | 67.9047 | 65.7206 | 2.1841 | 10.77 | 4.93 | 2.40 |
| Comp. Ex. A | 66.1836 | 64.0425 | 2.1411 | 10.77 | 5.03 | 2.45 |
| Example 1 | 68.2208 | 65.9646 | 2.2562 | 10.04 | 4.45 | 2.23 |
| Example 1 | 75.0237 | 72.7629 | 2.2608 | 10.04 | 4.40 | 2.20 |
| Example 2 | 71.7112 | 69.4847 | 2.2265 | 10.34 | 4.64 | 2.32 |
| Example 2 | 64.9833 | 62.8694 | 2.1139 | 10.34 | 4.89 | 2.45 |
| Example 3 | 65.4763 | 63.1830 | 2.2933 | 11.07 | 4.82 | 2.41 |
| Example 3 | 69.9478 | 67.6469 | 2.3009 | 11.07 | 4.81 | 2.41 |
| Comp. Ex B | 63.5756 | 61.2661 | 2.3095 | 10.96 | 4.75 | 2.31 |
| Comp. Ex. B | 69.9833 | 67.1394 | 2.8439 | 10.96 | 3.85 | 1.88 |

*Higher number is more wear resistance.

It is apparent that by smoothing out the particle size distribution one can affect the wear properties, as well as the welding characteristics, of the hardfacing without making major changes to the base formulation of the composition. One can balance the application process including the ease of applying the hardfacing, against the metallurgical benefits (e.g., wear properties) of the hardfacing. For example, a smaller hard particle distribution may allow for flow so that one can apply the hardfacing with greater ease during an oxyacetylene process, but such a hardfacing will not have as good as wear properties as a rod with coarser hard particles.

Applicant also expects to utilize the inventive particle size distributions along with various alloys. These hardfacing compositions can use alloys such as Invar® Alloy or Inconel® Alloy or Monel® Alloy. Invar® is a registered trademark of Imphy S.A. Corporation of Paris, France. The composition (in weight percent) of the commercially available Invar® alloy is 31% nickel-5% cobalt-64% iron. Inconel® is a registered trademark of Huntington Alloy Corporation. The composition of the commercially available Inconel® alloy is 76% nickel-17% chromium-7% iron. Monel® is a registered trademark of Huntington Alloy Corporation. The composition of the commercially available Monel® alloy is 28% copper-67% nickel-3% iron-2% manganese. These hardfacing compositions are expected to provide the hardfacing compositions with properties connected with the addition of these corrosion-resistant high temperature alloys such as, for example, the ability of the weld pool to maintain the cemented (cobalt) tungsten carbide intact (or at least prevent their compete dissolution) in those instances when the welders overheated the weld pool during the formation of the hardfacing deposit.

Table 8 below presents the basic composition of Inventive Example No. 5, except that each one of these components will be reduced by 3 percent so as to accommodate an overall addition of 3 percent of the alloy. These alloys could be one or more of the above listed alloys or include one or more of any of nickel, Invar®, Inconel®, and Monel®. The alloys Invar®, Inconel®, Monel® have already been described above. In regard to the nickel, it is NI-124 with the following properties: 100/325 mesh spherical high density, 99.9% purity, density is 8.903 grams/$cm^3$, Brinnell hardness annealed is equal to 75, and the coefficient of expansion @20 degrees Centigrade is equal to $13.3\times10^{-6}$, electrical resistivity is equal to 6.844 microhm-cm and the crystal structure is face centered cubic.

TABLE 8

Hardfacing Composition (Weight Percent) of Inventive Example No. 5

| Description | Wt. % |
|---|---|
| 10 × 24 pellets | 4 |
| 18 × 35 pellets | 8 |
| 20/30 pellets | 18 |
| 30/40 pellets | 30 |
| 100 × 325 pellets | 5 |
| 20/40 Kenface | 10 |
| 40/80 Kenface | 7 |
| 40/80 cast | 5 |
| 100/200 cast | 5 |
| 60/170 Si—Mn | 4 |
| −325 mesh WC | 4 |

As can be appreciated from the above-disclosed inventive hardfacing compositions, there are essentially no gaps in the particle size distribution of the hard particles in inventive examples. What this means is that particle size distribution fluctuations from the most populous size range to the smallest particle size range has been minimized and reduced from what has heretofore been available.

Figure 4:
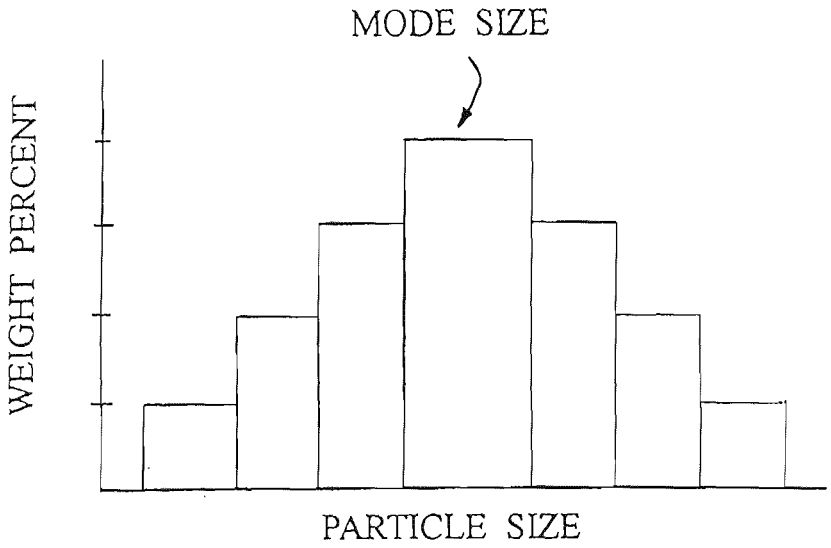
FIG. 4 is a histogram that shows a theoretical particle size distribution for one exemplary hardfacing composition.

In this regard, FIG. 4 is a histogram that shows a theoretical particle size distribution for one exemplary hardfacing composition. The vertical axis presents the weight percent and the horizontal axis presents the particle size distribution in particle size ranges. Because this particle size distribution is theoretical, there are no specific weight percentages or particle sizes listed on the histogram. However, it should be appreciated that the total weight percent equals one hundred weight percent and the particle size ranges are those that would be suitable for use as a hardfacing.

Figure 5:
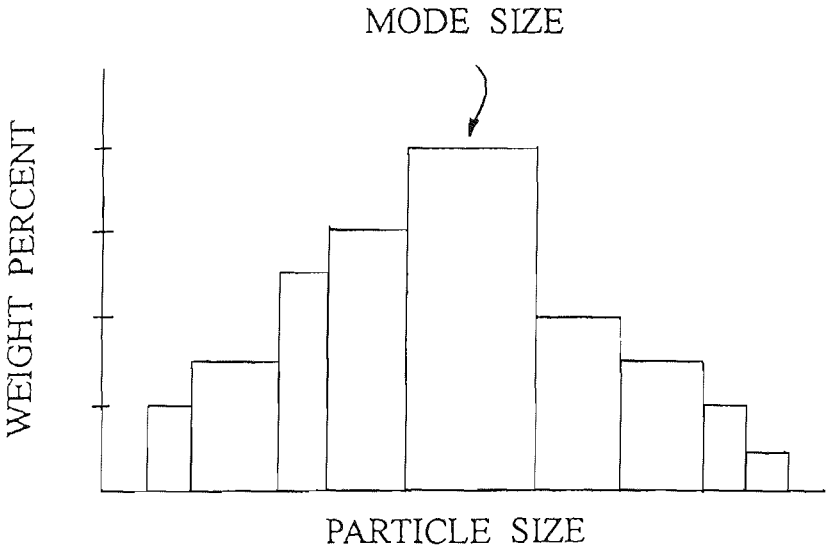
FIG. 5 is a histogram that shows a theoretical particle size distribution for another exemplary hardfacing composition.

In this histogram of FIG. 4, the most populous particle size distribution is the mode size. See Randall M. German, *Powder Metallurgy Science*, Metal Powder Industries Federation, Princeton, N.J. (1984) including the text at page 28. As can be seen, while the configuration of the particle size distribution is not a perfect bell curve, there are essentially no substantial fluctuations in the particle size distribution from the mode size to the smallest particle size distribution or from the mode size to the largest particle size distribution. In other words, one could say that there is a substantially smooth transition from the mode size (i.e., most populous particle size distribution) to the smallest particle size distribution and a substantially smooth transition from the mode size to the largest particle size distribution As another example, FIG. 5 is a histogram that shows a theoretical particle size distribution for another exemplary hardfacing composition. The vertical axis presents the weight percent and the horizontal axis presents the particle size distribution in particle size ranges. Because this particle size distribution is theoretical, there are no specific weight percentages or particle sizes listed on the histogram. However, it should be appreciated that the total weight percent equals one hundred weight percent and the particle size ranges are those that would be suitable for use as a hardfacing.

In this histogram, like for FIG. 4, the most populous particle size distribution is the mode size. As can be seen, while the configuration of the particle size distribution is different from that of FIG. 4, there still are essentially no substantial fluctuations in the particle size distribution from the mode size to the smallest particle size distribution or from the mode size to the largest particle size distribution. In other words, one could say that there is a substantially smooth transition from the mode size (i.e., most populous particle size distribution) to the smallest particle size distribution and a substantially smooth transition from the mode size to the largest particle size distribution.

As one can appreciate, there are advantages connected with a hard facing composition that exhibits a particle size distribution that promotes a more uniform distribution in the weld pool. This is shown by FIGS. 6 and 7.

Figure 6:
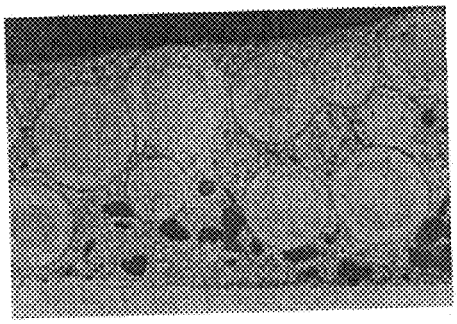
FIG. 6 is a photomicrograph of a cross-section of an as-deposited weld pool of a prior art commercial hardfacing composition.
Figure 7:
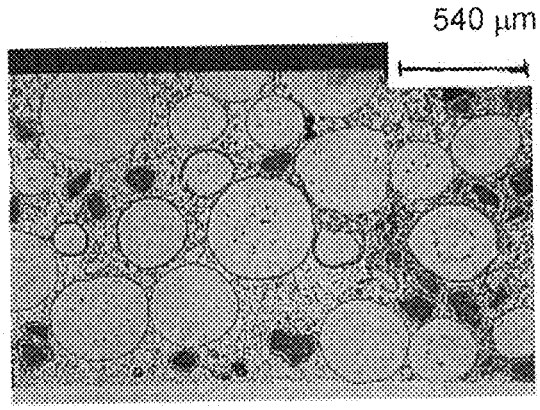
FIG. 7 is a photomicrograph of a cross-section of an as-deposited weld pool of an inventive hardfacing composition.

FIG. 6 is a photomicrograph of a cross-section of a weld pool of a prior art commercial hardfacing deposit showing the microstructure. As is apparent from a examination of the photomicrograph, there is segregation of the larger size hard particles from the smaller size hard particles. The smaller size hard particles have migrated to the bottom of the weld pool. Such segregation of the hard particles is an undesirable property of a hardfacing deposit weld pool.

By providing the particle size distribution of the inventive hardfacing compositions, the segregation of the hard particles is reduced or eliminated from the as-deposited weld pool. FIG. 7 is a photomicrograph of a cross-section of a weld pool of an inventive hardfacing deposit. As can be seen from an examination of the photomicrograph, the hard particles are much more uniformly distributed throughout the as-deposited weld pool. In other words, there is no marked segregation of the larger size hard particles from the smaller size particles. In comparing the microstructures of FIGS. 6 and 7, it becomes apparent that the inventive hard facing composition results in an as-deposited weld pool with a much more uniform microstructure than does the prior art commercial hardfacing composition.

Typically, hardfacing compositions that contain hard particles of a finer size exhibit faster welding characteristics (e.g., faster flow and faster weldability). This means that the operator can more easily and quickly apply the weld to the substrate. However, a hardfacing composition that contains hard particles of a finer size, typically exhibits lesser wear resistance. While there may be manufacturing or production advantages connected with the property of more easily applying the hardfacing, there can be a drawback due to a reduction in the wear resistance of the hardfacing deposit.

Conversely, hardfacing compositions that contain hard particles of a larger size (i.e., more coarse) exhibit slower welding characteristics (e.g., slower flow and workability decreases). This means that the operator may experience more difficulty and take more time to apply the weld to the substrate. However, a hardfacing composition that contains hard particles of a larger (coarse) size, typically exhibits better wear resistance. While there may be performance advantages due to a higher wear resistance of the hardfacing deposit, there can be a drawback connected with the application of the hardfacing deposit.

When the particle size distribution uses a plurality of basic hard particle size ranges, a balance between the weldability and the wear resistance can exist. When the hard particles of the hardfacing composition fall in these kinds of ranges, the hardfacing composition exhibits acceptable weldability and acceptable wear resistance.

While other factors can contribute, the use of hard particles of varying sizes can result in a more even or uniform distribution of the hard particles. A more uniform or even distribution of the hard particles can result in a better distribution of heat throughout the as-deposited weld pool. Better heat distribution during the deposition process reduces the potential to melt the tungsten carbide particles. Further, a more uniform or even distribution of the hard particles can result in a more even or uniform settling of the hard particles in the molten weld pool. As discussed above, a more even distribution or settling of the hard particles results in a hardfacing deposit with better performance properties.

As one instance, three basic particle size distributions can result in a hardfacing composition with desirable properties. These basic particle size distributions would be a coarser particle size range, a mediate or middle particle size range, and a finer particle size range. These particle size ranges are relative so a specific particle size range may be mediate in one hardfacing composition and coarse in another hardfacing composition. In the instance where there are three particle size distributions, it is apparent that the hardfacing composition includes a plurality of hard particles wherein the hard particles comprise a plurality of particle size distributions. The particle size distributions comprise a coarse particle size distribution wherein the hard particles in the coarse particle size distribution provide wear resistance. The particle size distributions further comprise a fine particle size distribution wherein the hard particles in the fine particle size distribution provide improved weldability. The particle size distributions also comprise a mediate particle size distribution wherein the hard particles in the mediate particle size distribution facilitate generally uniform distribution of the hard particles of the hardfacing composition.

As mentioned above, the three basic particle size distributions comprise hard particles with a coarse particle size, a mediate particle size and a finer particle size. Depending upon the specific application, the coarse particle sizes can range between −16+20 Mesh to −30+40 Mesh hard particles. Depending upon the specific application, the mediate or middle particle sizes can range between −20+40 to −100+200 Mesh hard particles. Depending upon the specific application, the finer particle sizes can range between −60+170 Mesh to −325 Mesh hard particles.

Figure 8:
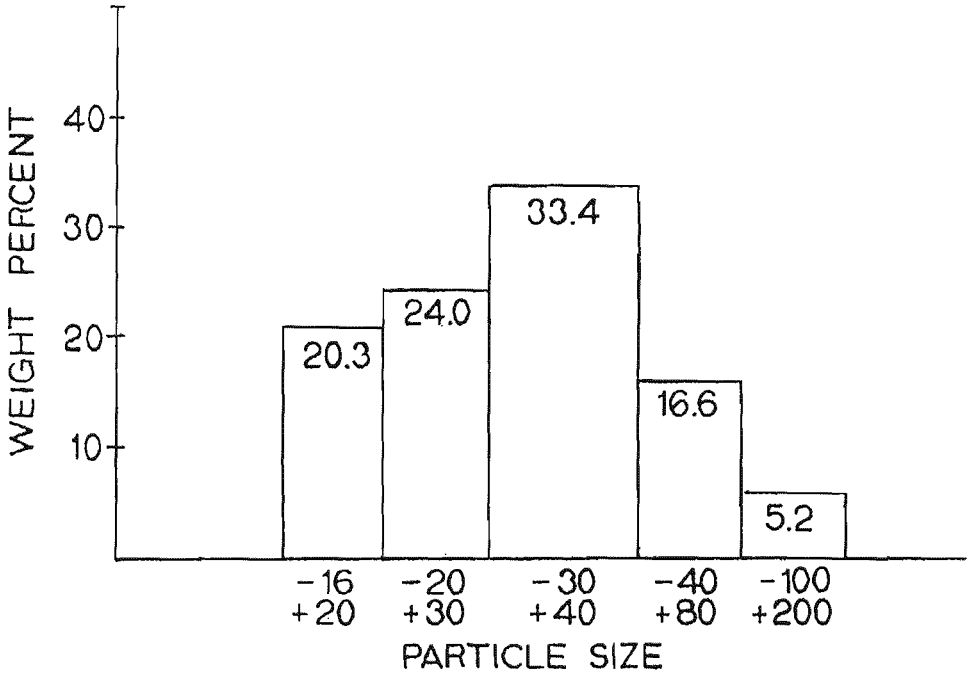
FIG. 8 is a histogram that shows the particle size distribution (weight percent vs. particle size in Mesh) for Example No. 6.

Another specific embodiment of the hardfacing composition is set forth below. Table 9 sets forth the composition of the hard components of the hardfacing composition Example No. 6. The hardfacing composition comprises the hard particles and the deoxidizer (e.g., Si—Mn). In the specific Example No. 6, the hardfacing composition comprises 66 weight percent of the overall hardfacing deposit wherein the balance (i.e., 34 weight percent) is steel. FIG. 8 is a histogram showing the particle size distribution for Example No. 6.

TABLE 9

Hardfacing Composition (Weight Percent) of Inventive Example No. 6

| Description | Weight Percentage of the Overall Fill | Weight Percentage of Hardfacing Composition | Weight Percentage of the Hard Particles |
|---|---|---|---|
| −16 + 20 pellets | 13.2 | 20% | 20.8% |
| −20 + 30 pellets | 15.2 | 23% | 24.0% |
| −30 + 40 pellets | 21.1 | 32% | 33.4% |
| −40 + 80 Kenface | 4.0 | 6% | 6.2% |
| −40 + 80 cast | 6.6 | 10% | 10.4% |
| 100 + 200 cast | 3.3 | 5% | 5.2% |
| −60 + 170 Si—Mn | 2.6 | 4% | N/A |
| Steel (.015 × .566) | 34.0 | N/A | N/A |

As discussed above, the use of finer hard particles in the hardfacing composition typically results in better welding properties and worse wear resistance properties. The use of coarser hard particles in the hardfacing composition typically results in worse welding properties and better wear resistance properties. As demonstrated by a hardfacing composition like Example No. 6, there can be a balance between the properties of weldability and wear resistance through the selection of a specific particle size distribution of the hard particles. In some instances, the shape of a particle size distribution can take on the general shape of a bell-shaped curve, or in the alternative, it can take on the shape of a bi-modal distribution.

Figure 9:
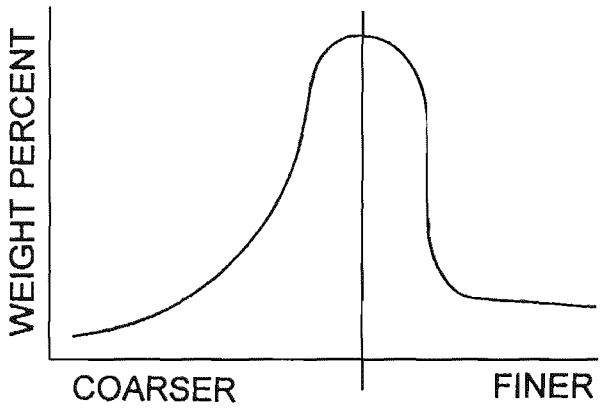
FIG. 9 is a plot of weight percent vs. hard particle size for a hypothetical hardfacing composition showing the hard particle distribution wherein the greater concentration of hard particles is mid-way between the coarser hard particles and the finer hard particles.
Figure 10:
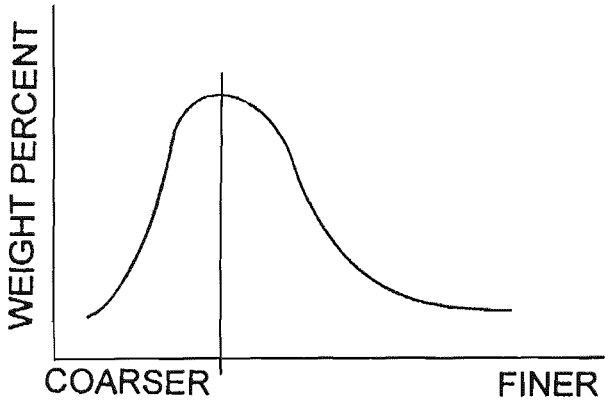
FIG. 10 is a plot of weight percent vs. hard particle size for a hypothetical hardfacing composition showing the hard particle distribution wherein the greater concentration of hard particles is skewed toward the coarser hard particles.
Figure 11:
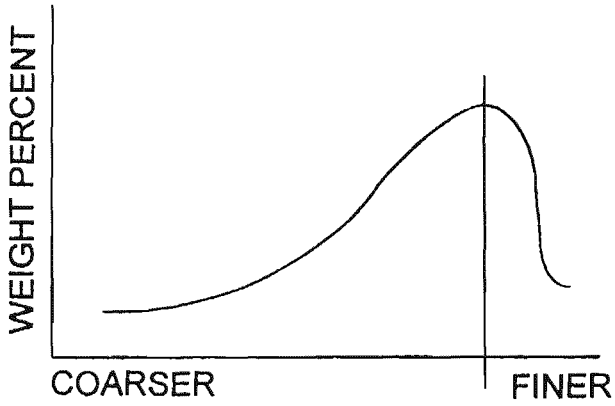
FIG. 11 is a plot of weight percent vs. hard particle size for a hypothetical hardfacing composition showing the hard particle distribution wherein the greater concentration of hard particles is skewed toward the finer hard particles.

In further reference to the hard particle size distribution, FIGS. 9 through 11 illustrate the general shape of different hard particle size distributions for hypothetical hardfacing composition. These hard particle size distributions exhibit a balance between the welding characteristics and the wear resistance properties. For example, the hard particle size distribution shown by FIG. 9 is an even balance of the hard particle size distribution. This kind of hard particle size distribution results in an even balance between the welding characteristics and the wear resistance properties. The hard particle size distribution shown by FIG. 10 is skewed somewhat in the direction of a greater concentration of the coarser hard particles, which results in a greater emphasis on the wear resistance properties and a lesser emphasis on the welding characteristics. The hard particle size distribution shown by FIG. 11 is skewed somewhat in the direction of a greater concentration of the finer hard particles, which results in a greater emphasis on the welding characteristics and a lesser emphasis on the wear resistance properties.

Each of the hard particle size distributions illustrated by FIGS. 9 through 11 satisfy the condition of a hardfacing composition that contains hard particles that exhibit particle size distributions wherein there are no (or at least there are minimal) gaps or no significant fluctuations in the particle size distribution such that the hard particles have sizes that are within certain ranges of particle size distributions so as to not interrupt the smooth distribution of hard particles across the spectrum of available particle size distributions. In the hard particle size distributions illustrated by FIGS. 9 through 11, the medium sized hard particles combine with the coarser hard particles and the finer hard particles to provide a hardfacing rod with desirable properties that are not dominated by either the coarser hard particles or the finer hard particles. The hard particle size distribution can be adjusted (e.g., skewed in either direction) depending upon the needs of the particle application so as to address the concerns of the welding operation as well as the concerns for wear resistance.

As set forth hereinabove, one of the advantages to a hardfacing composition containing hard particles wherein there are no gaps (i.e., no significant fluctuations) in the particle size distribution is the reduction or elimination of migration of the hard particles to the bottom of the liquid weld pool during application. Applicant expects that the hardfacing deposit from any of the inventive examples would provide a hardfacing deposit that exhibits a consistency wherein the hard particles would not have migrated to the bottom of the liquid weld pool. In this regard, the applicant expects that the hard particles (e.g., cast tungsten carbide particles and cemented (cobalt) tungsten carbide pellets) are more uniformly distributed throughout the microstructure of the hardfacing deposit. Applicant would also expect that smaller-sized cemented (cobalt) tungsten carbide pellets would remain intact in the hardfacing deposit.

In the examples set forth above, tungsten carbide or a tungsten carbide-based material has been the focus of the composition. It should be appreciated that other kinds of hard materials can be suitable for use in these hardfacing compositions. Exemplary of the material can be diamonds, cermets and possibly even ceramics.

It can be appreciated that the inventive hardfacing compositions contain hard particles that exhibit particle size distributions wherein there are no (or at least there are minimal) gaps or no significant fluctuations in the particle size distribution. By providing a hardfacing composition that contains hard particles with no or minimal gaps or no significant fluctuations in the particle size distribution, (i.e., the hard particles have sizes that are within certain ranges of particle size distributions so as to not interrupt the smooth distribution of hard particles across the spectrum of available particle size distributions) applicant has provided a solution to current drawbacks.

It can be appreciated that through the inventive hardfacing composition containing hard particles, applicant has provided an improved hardfacing composition (including an improved hardfacing rod) that does not present gaps in the particle size distribution so as to reduce or eliminate the shifting of particles due to the jostling of the hardfacing rod. Further, it can also be appreciated that through the inventive hardfacing composition containing hard particles, applicant has provided an improved hardfacing composition (including an improved hardfacing rod) containing hard particles that does not present gaps in the particle size distribution, and as a result, reduces or eliminates the migration of the hard particles in the liquid weld pool during the welding operation. In addition, it becomes apparent that through the inventive hardfacing composition containing hard particles, applicant has provided an improved hardfacing composition (including an improved hardfacing rod) that does not present gaps in the particle size distribution, and thereby reduces or eliminates the segregation of deoxidizer so as to reduce or eliminate the presence of trapped gas pockets in the hardfacing deposit.

The patents, patent applications, and other documents identified herein are hereby incorporated by reference herein.

Other embodiments of the invention will be apparent to those skilled in the art from a consideration of the specification of the practice of the invention disclosed herein. It is intended that the specification and examples be considered as illustrative only, and that the true spirit and scope of the invention being indicated by the following claims.

What is claimed is:

1. A hardfacing composition comprising a plurality of hard particles wherein the hard particles comprise a mode particle size distribution present in an amount equal to a mode particle size weight percent of the hard particles in the hardfacing composition, one particle size distribution smaller than the mode particle size distribution and present in an amount equal to a one particle size weight percent of the hard particles in the hardfacing composition, and an other particle size distribution larger than the mode particle size distribution and present in an amount equal to an other particle size weight percent of the hard particles in the hardfacing composition; there being a substantially smooth transition between the mode particle size distribution and the one particle size distribution and there being a substantially smooth transition between the mode particle size distribution and the other particle size distribution; and wherein the one particle size weight percent ranges between about 40 percent and about 50 percent of the mode particle size weight percent, and the other particle size weight percent ranges between about 60 percent and about 72 percent of the mode particle size weight percent.

2. The hardfacing composition of claim 1 wherein the hard particles include one or more of crushed sintered cemented (cobalt) macrocrystalline tungsten carbide particles, cemented tungsten carbide-cobalt pellets, and cast tungsten carbide particles, diamonds, cermets and ceramics.

3. The hardfacing composition of claim 1 wherein the hardfacing composition further includes a deoxidizer.

4. The hardfacing composition of claim 1 wherein the hardfacing composition further includes an alloy steel.

5. The hardfacing composition of claim 1 wherein hard particles in the size range of −16+20 Mesh comprise between about 10 weight percent and about 20 weight percent of the hard particles of the hardfacing composition, hard particles in the size range of −20+30 Mesh comprise between about 20 weight percent and about 26 weight percent of the hard particles of the hardfacing composition, hard particles in the size range of −30+40 Mesh comprise between about 30 weight percent and about 35 weight percent of the hard particles of the hardfacing composition, hard particles in the size range of −40+80 Mesh comprise between about 10 weight percent and about 20 weight percent of the hard particles of the hardfacing composition, hard particles in the size range of −100+200 Mesh comprise between about 3 weight percent and about 7 weight percent of the hard particles of the hardfacing composition, and hard particles in the size range of −325 Mesh comprise between about 3 weight percent and about 7 weight percent of the hard particles of the hardfacing composition.

6. The hardfacing composition of claim 1 wherein hard particles in the size range of −10+24 Mesh comprise between about 2 weight percent and about 6 weight percent of the hard particles of the hardfacing composition, hard particles in the size range of −18+35 Mesh comprise between about 5 weight percent and about 10 weight percent of the hard particles of the hardfacing composition, hard particles in the size range of −40+80 Mesh comprise between about 10 weight percent and about 15 weight percent of the hard particles of the hardfacing composition, hard particles in the size range of −100+325 Mesh comprise between about 3 weight percent and about 7 weight percent of the hard particles of the hardfacing composition, hard particles in the size range of −20+40 Mesh comprise between about 45 weight percent and about 75 weight percent of the hard particles of the hardfacing composition wherein in the size range of −20+40 Mesh there being hard particles in the size range of −20+30 Mesh between about 15 weight percent and about 25 weight percent of the hard particles of the hardfacing composition and hard particles in the size range of −30+40 Mesh between about 25 weight percent and about 35 weight percent of the hard particles of the hardfacing composition, hard particles in the size range of −100+200 Mesh comprise between about 3 weight percent and about 7 weight percent of the hard particles of the hardfacing composition, hard particles in the size range of −325 Mesh comprise between about 2 weight percent and about 6 weight percent of the hard particles of the hardfacing composition.

7. The hardfacing composition of claim 1 wherein hard particles in the size range of −10+24 Mesh comprise between about 2 weight percent and about 6 weight percent of the hard particles of the hardfacing composition, hard particles in the size range of −18+35 Mesh comprise between about 5 weight percent and about 10 weight percent of the hard particles of the hardfacing composition, hard particles in the size range of −100+325 Mesh comprise between about 3 weight percent and about 7 weight percent of the hard particles of the hardfacing composition, and hard particles in the size range of −20+40 Mesh comprise between about 45 weight percent and about 70 weight percent of the hard particles of the hardfacing composition wherein in the size range of −20+40 Mesh there being hard particles in the size range of −20+30 Mesh between about 15 weight percent and about 20 weight percent of the hard particles of the hardfacing composition and hard particles in the size range of −30+40 Mesh between about 25 weight percent and about 35 weight percent of the hard particles of the hardfacing composition, hard particles in the size range of −40+80 Mesh comprise between about 10 weight percent and about 15 weight percent of the hard particles of the hardfacing composition, hard particles in the size range of −100+200 Mesh comprise between about 3 weight percent and about 7 weight percent of the hard particles of the hardfacing composition, hard particles in the size range of −325 Mesh comprise between about 2 weight percent and about 6 weight percent of the hard particles of the hardfacing composition.

8. The hardfacing composition of claim 1 wherein hard particles in the size range of −16+20 Mesh comprise between about 15 weight percent and about 25 weight percent of the hard particles of the hardfacing composition, hard particles in the size range of −20+30 Mesh comprise between about 20 weight percent and about 28 weight percent of the hard particles of the hardfacing composition, hard particles in the size range of −30+40 Mesh comprise between about 28 weight percent and about 38 weight percent of the hard particles of the hardfacing composition, hard particles in the size range of −40+80 Mesh comprise between about 11 weight percent and about 21 weight percent of the hard particles of the hardfacing composition, and hard particles in the size range of −100+200 Mesh comprise between about 3 weight percent and about 7 weight percent of the hard particles of the hardfacing composition.

9. A hardfacing composition comprising a plurality of hard particles wherein the hard particles comprise a mode particle size distribution present in an amount equal to a mode particle size weight percent of the hard particles in the hardfacing composition, one particle size distribution smaller than the mode particle size distribution and present in an amount equal to a one particle size weight percent of the hard particles in the hardfacing composition, and an other particle size distribution larger than the mode particle size distribution and present in an amount equal to an other particle size weight percent of the hard particles in the hardfacing composition; there being an absence of any substantial fluctuations in the particle size distribution between the mode particle size distribution and the one particle size distribution and there being an absence of any substantial fluctuations in the particle size distribution between the mode particle size distribution and the other particle size distribution; and wherein the one particle size weight percent ranges between about 40 percent and about 50 percent of the mode particle size weight percent, and the other particle size weight percent ranges between about 60 percent and about 72 percent of the mode particle size weight percent.

10. The hardfacing composition of claim 9 wherein the hard particles include one or more of crushed sintered cemented (cobalt) macrocrystalline tungsten carbide particles, cemented tungsten carbide-cobalt pellets, and cast tungsten carbide particles, diamonds, cermets and ceramics.

11. The hardfacing composition of claim 9 wherein the hardfacing composition further includes a deoxidizer.

12. The hardfacing composition of claim 9 wherein the hardfacing composition further includes an alloy steel.

13. The hardfacing composition of claim 9 wherein hard particles in the size range of −16+20 Mesh comprise between about 10 weight percent and about 20 weight percent of the hard particles of the hardfacing composition, hard particles in the size range of −20+30 Mesh comprise between about 20 weight percent and about 26 weight percent of the hard particles of the hardfacing composition, hard particles in the size range of −30+40 Mesh comprise between about 30 weight percent and about 35 weight percent of the hard particles of the hardfacing composition, hard particles in the size range of −40+80 Mesh comprise between about 10 weight percent and about 20 weight percent of the hard particles of the hardfacing composition, hard particles in the size range of −100+200 Mesh comprise between about 3 weight percent and about 7 weight percent of the hard particles of the hardfacing composition, and hard particles in the size range of −325 Mesh comprise between about 3 weight percent and about 7 weight percent of the hard particles of the hardfacing composition.

14. The hardfacing composition of claim 9 wherein hard particles in the size range of −10+24 Mesh comprise between about 2 weight percent and about 6 weight percent of the hard particles of the hardfacing composition, hard particles in the size range of −18+35 Mesh comprise between about 5 weight percent and about 10 weight percent of the hard particles of the hardfacing composition, hard particles in the size range of −40+80 Mesh comprise between about 10 weight percent and about 15 weight percent of the hard particles of the hardfacing composition, hard particles in the size range of −100+325 Mesh comprise between about 3 weight percent and about 7 weight percent of the hard particles of the hardfacing composition, hard particles in the size range of −20+40 Mesh comprise between about 45 weight percent and about 75 weight percent of the hard particles of the hardfacing composition wherein in the size range of −20+40 Mesh there being hard particles in the size range of −20+30 Mesh between about 15 weight percent and about 25 weight percent of the hard particles of the hardfacing composition and hard particles in the size range of −30+40 Mesh between about 25 weight percent and about 35 weight percent of the hard particles of the hardfacing composition, hard particles in the size range of −100+200 Mesh comprise between about 3 weight percent and about 7 weight percent of the hard particles of the hardfacing composition, hard particles in the size range of −325 Mesh comprise between about 2 weight percent and about 6 weight percent of the hard particles of the hardfacing composition.

15. The hardfacing composition of claim 9 wherein hard particles in the size range of −10+24 Mesh comprise between about 2 weight percent and about 6 weight percent of the hard particles of the hardfacing composition, hard particles in the size range of −18+35 Mesh comprise between about 5 weight percent and about 10 weight percent of the hard particles of the hardfacing composition, hard particles in the size range of −100+325 Mesh comprise between about 3 weight percent and about 7 weight percent of the hard particles of the hardfacing composition, and hard particles in the size range of −20+40 Mesh comprise between about 45 weight percent and about 70 weight percent of the hard particles of the hardfacing composition wherein in the size range −20+40 Mesh there being hard particles in the size range of −20+30 Mesh between about 15 weight percent and about 20 weight percent of the hard particles of the hardfacing composition and hard particles in the size range of −30+40 Mesh between about 25 weight percent and about 35 weight percent of the hard particles of the hardfacing composition, hard particles in the size range of −40+80 Mesh comprise between about 10 weight percent and about 15 weight percent of the hard particles of the hardfacing composition, hard particles in the size range of −100+200 Mesh comprise between about 3 weight percent and about 7 weight percent of the hard particles of the hardfacing composition, hard particles in the size range of −325 Mesh comprise between about 2 weight percent and about 6 weight percent of the hard particles of the hardfacing composition.

16. A hardfacing composition comprising a plurality of hard particles wherein the hard particles comprise a mode particle size distribution, one particle size distribution smaller than the mode particle size distribution, and an other particle size distribution larger than the mode particle size distribution; and there being an absence of any substantial fluctuations in the particle size distribution between the mode particle size distribution and the one particle size distribution and there being an absence of any substantial fluctuations in the particle size distribution between the mode particle size distribution and the other particle size distribution, and wherein hard particles in the size range of −16+20 Mesh comprise between about 15 weight percent and about 25 weight percent of the hard particles of the hardfacing composition, hard particles in the size range of −20+30 Mesh comprise between about 20 weight percent and about 28 weight percent of the hard particles of the hardfacing composition, hard particles in the size range of −30+40 Mesh comprise between about 28 weight percent and about 38 weight percent of the hard particles of the hardfacing composition, hard particles in the size range of −40+80 Mesh comprise between about 11 weight percent and about 21 weight percent of the hard particles of the hardfacing composition, and hard particles in the size range of −100+200 Mesh comprise between about 3 weight percent and about 7 weight percent of the hard particles of the hardfacing composition.

17. A hardfacing composition having selected weldability characteristics and selected wear resistance properties comprising a plurality of hard particles wherein the hard particles comprise:

a plurality of hard particle size distributions, and wherein the hard particle size distributions comprise:

a coarse hard particle size distribution wherein the hard particles in the coarse hard particle size distribution enhance wear resistance of the hardfacing composition, and the coarse hard particle distribution present in an amount equal to a coarse hard particle weight percent, a fine hard particle size distribution wherein the hard particles in the fine hard particle size distribution enhance weldability characteristics, and the fine hard particle distribution present in an amount equal to a fine hard particle weight percent, and a mediate hard particle size distribution wherein the hard particles in the mediate hard particle size distribution facilitate generally uniform distribution of the hard particles in the fine hard particle size distribution of the hardfacing composition, and the moderate hard particle distribution present in an amount equal to a moderate hard particle weight percent; and the coarse hard particle size distribution, the fine hard particle size distribution, and the medium hard particle size distribution being present in amounts to provide the selected weldability characteristics and selected wear resistance properties of the hardfacing composition wherein the coarse hard particle weight percent is between about 60 percent and 72 percent of the moderate hard particle weight percent, and the fine hard particle weight percent is between about 40 percent and about 50 percent of the moderate hard particle weight percent.

* * * * *